US007076077B2

(12) United States Patent
Atsumi et al.

(10) Patent No.: US 7,076,077 B2
(45) Date of Patent: Jul. 11, 2006

(54) BONE CONDUCTION HEADSET

(75) Inventors: Tomoya Atsumi, Tokyo (JP); Mikio Fukuda, Tokyo (JP); Kazuji Kobayashi, Tokyo (JP)

(73) Assignee: Temco Japan Co., Ltd., Tokyo (JP)

( * ) Notice: Subject to any disclaimer, the term of this patent is extended or adjusted under 35 U.S.C. 154(b) by 224 days.

(21) Appl. No.: 10/479,882

(22) PCT Filed: Jul. 4, 2002

(86) PCT No.: PCT/JP02/06781

§ 371 (c)(1),
(2), (4) Date: Dec. 8, 2003

(87) PCT Pub. No.: WO03/005766

PCT Pub. Date: Jan. 16, 2003

(65) Prior Publication Data

US 2004/0197002 A1 Oct. 7, 2004

(30) Foreign Application Priority Data

Jul. 5, 2001 (JP) ..... 2001-204815

(51) Int. Cl.
*H04R 25/00* (2006.01)

(52) U.S. Cl. ..... 381/380; 381/151; 381/326

(58) Field of Classification Search ..... 381/151, 381/326, 327, 330, 370, 378, 380–381; 181/126, 181/128, 130, 135
See application file for complete search history.

(56) References Cited

U.S. PATENT DOCUMENTS

| | | | | |
|---|---|---|---|---|
| 1,531,543 | A * | 3/1925 | Cooper | 381/151 |
| 4,821,323 | A * | 4/1989 | Papiernik | 381/151 |
| 5,450,496 | A * | 9/1995 | Burris et al. | 381/381 |
| 5,608,808 | A * | 3/1997 | da Silva | 381/327 |
| 6,104,824 | A * | 8/2000 | Ito | 381/381 |
| 6,456,721 | B1 * | 9/2002 | Fukuda | 381/380 |
| 6,721,433 | B1 * | 4/2004 | Sato | 381/381 |
| 6,879,699 | B1 * | 4/2005 | Logan | 381/381 |

* cited by examiner

*Primary Examiner*—Suhan Ni
(74) *Attorney, Agent, or Firm*—Schmeiser, Olson & Watts

(57) ABSTRACT

An object of the invention resides in the provision of a bone conduction headset, which is inconspicuous in appearance during wearing thereof, adapted for use in avoiding absorbing nearby people's attention to the headset thus worn, easy to wear and take off in use, and comprises: a band running around a back part of the user's head; a fastening portion formed in each of opposite end portions of the band; a bone conduction speaker provided with a knob which is engaged with the fastening portion; and, an ear engagement portion, which runs over the bone conduction speaker during wearing of the headset to reach and engage with the user's ear. An extension of either the fastening portion in the band or a casing of the bone conduction speaker may be formed into the ear engagement portion.

5 Claims, 6 Drawing Sheets

BONE CONDUCTION HEADSET

TECHNICAL FIELD

The present invention relates to a bone conduction headset, and more particularly to a bone conduction headset, which is easy to wear, and inconspicuous in appearance during wearing thereof to make it hard for people around a user to find the headset thus worn by the user.

BACKGROUND ART

In a bone conduction headset of a conventional type, a speaker 31 is mounted on each of opposite end portions of a head band 30 in a manner such that the speaker 31 is disposed in front of each of the user's opposite ears during wearing of the headset (FIG. 8). The band 30 runs around a back part of the user's head to have each of opposite end portions of the band 30 provided with an ear engagement portion 33. Mounted on a front end portion of the ear engagement portion 33 is the bone conduction speaker 31 which is adapted to be brought into contact with a front area of the user's head in front of each of the user's opposite ears during wearing of the headset (FIG. 9). There are two known types of the headset in the art, one of which types has the bone conduction speaker incorporated in an end portion of each of temples 34 of eyeglasses (FIG. 10), and the other has the bone conduction speaker mounted on an end portion of a clip 35 which is held on the ear (FIG. 11).

Any one of them is exposed extensively around the ear, and is therefore noticeable in appearance. This enables nearby people to immediately notice the presence of the headset thus worn by the user. Consequently, any one of the known types of the headset does not meet both the need of the user who is handicapped in hearing and therefore does not want for nearby people to notice the user's wearing of the headset, and the need of the guardsmen and other staff employed in an event site and the like.

DISCLOSURE OF THE INVENTION

As described in the above, any one of various types of the conventional headset has the disadvantage that the headset enables the nearby people to immediately notice the user's wearing of the headset when looked in front of the user. Consequently, it is an object of the present invention to provide a bone conduction headset, which is free from such disadvantage. In other words, the object of the present invention resides in the provision of a bone conduction headset speaker, which is easy to wear and take off in use, and is further inconspicuous in appearance during the user's wearing thereof, and therefore adapted for the user who does not want for nearby people to notice the user's wearing of the headset.

In order to accomplish the above object, the bone conduction speaker of the present invention is characterized by comprising: a band running around a back part of the user's head; a fastening portion formed in each of opposite end portions of the band; a bone conduction speaker provided with a knob which is engaged with the fastening portion; and, an ear engagement portion, which runs over the bone conduction speaker during wearing of the headset to reach and engage with the user's ear.

An extension of either the fastening portion in the band or a casing of the bone conduction speaker may be formed into the ear engagement portion.

BEST MODE FOR CARRYING OUT THE INVENTION

Figure 1:
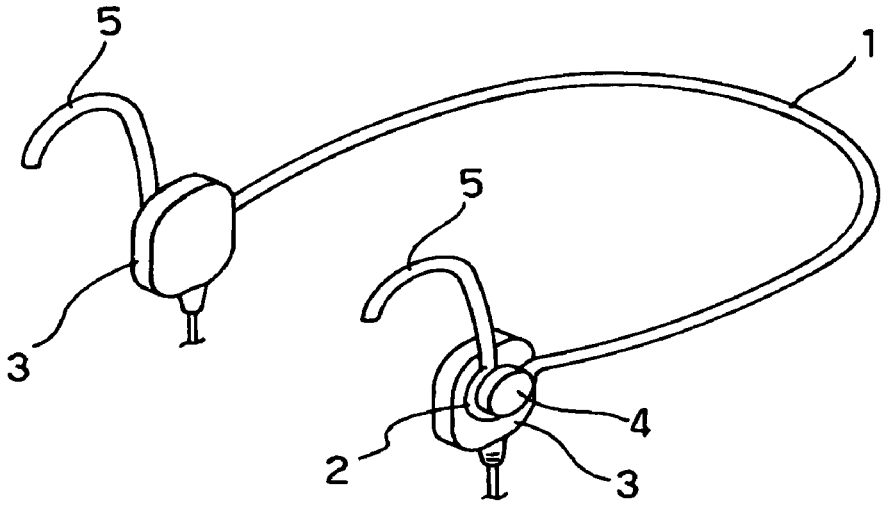
FIG. 1 is a perspective view of an embodiment of the present invention.
Figure 2:
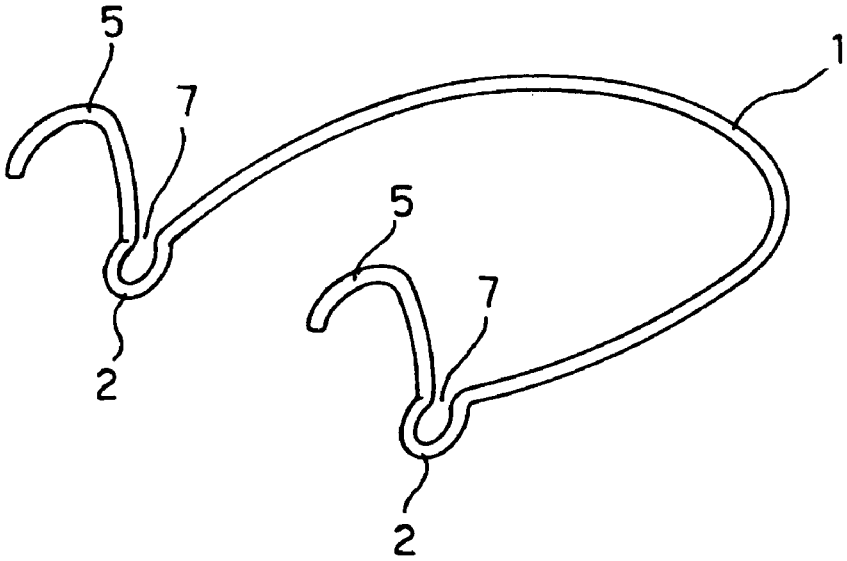
FIG. 2 is a view illustrating, in construction, the band of the embodiment shown in FIG. 1.

Hereinbelow, with reference to the accompanying drawings, embodiments of the present invention will be described. A bone conduction speaker of the present invention comprises: a band 1 running around a back part of the user's head; a fastening portion 2 formed in each of opposite end portions of the band 1; a bone conduction speaker 3 provided with a knob 4 which is engaged with the fastening portion 2; and, an ear engagement portion 5, which runs over the bone conduction speaker 3 during wearing of the headset to reach and engage with the user's ear.

FIG. 1 is a schematic view of an embodiment of the bone conduction headset of the present invention. In this embodiment, the ear engagement portion 5 is integrally formed in the band 1. In other words, the fastening portion 2 is formed in each of opposite end portions of the band 1 to assume a circularly-curved concave shape. Then, an end portion of the fastening portion 2 is extended upward and formed into the ear engagement portion 5, which engages with the user's ear.

Figure 3:
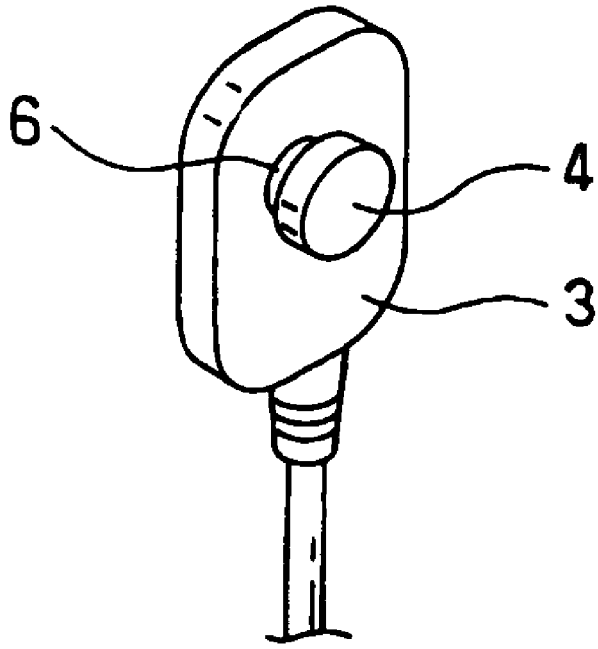
FIG. 3 is a view illustrating, in construction, the bone conduction speaker of the embodiment shown in FIG. 1.

Provided in an outer surface of the bone conduction speaker 3, i.e., provided in the reverse side of the speaker's inner surface brought into contact with the user's head is the knob 4 provided with a neck portion 6 (see FIG. 3). Provided in an upper portion of the fastening portion 2 is an entrance clearance 7 through which the neck portion 6 is inserted into the interior of the fastening portion 2 from above to make it possible for the fastening portion 2 to support the bone conduction speaker 3. In general, in this state, the bone conduction speaker 3 is movably supported.

Figure 4:
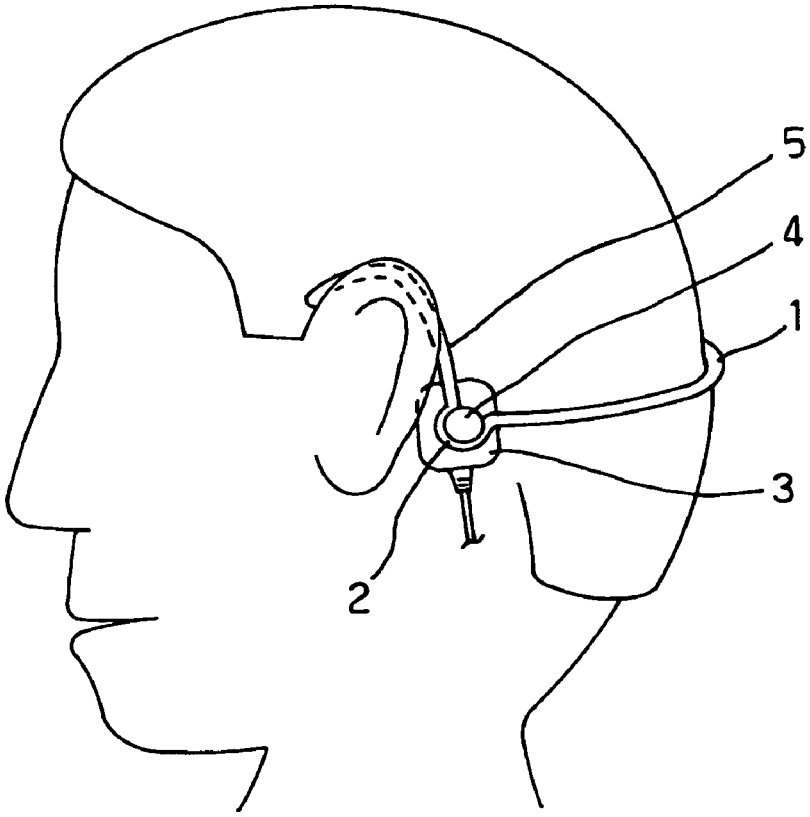
FIG. 4 is a view illustrating a state in which the headset of the embodiment shown in FIG. 1 is worn by the user.

When the user wants to wear the headset having the above construction around the user's head, it suffices only to hang the ear engagement portion 5 of the headset on the user's ear in a condition in which the band 1 having the bone conduction speaker 3 mounted on the fastening portion 2 runs around the back part of the user's head (see FIG. 4). In this worn state, the bone conduction speaker 3 hides behind the user's ear, and is therefore inconspicuous in appearance, so that it is hard for the people around the user to find the handset thus worn by the user. In general, since the bone conduction speaker 3 is movably supported by the fastening portion 2, it is possible for the user to adjust, in position, each of the speakers 3 so as to have each speaker 3 snugly fit to the user's head.

The band 1 is moderate in resiliency, which, in wearing, makes it possible for the bone conduction speaker 3 to be brought into close contact with the user's head at an area behind the ear with a moderate contact pressure. The band 1 may vary in size to provide a plurality of its variations, which make it possible for each of the users varying in size to select a suitable one of the variations of the band 1. It is natural to replace the band 1 having been used with a new one in use.

Further, when the band 1 is made of a shape memory alloy, it is possible for the band 1 to improve its resiliency in stability. In addition, this makes it also possible for the band 1 to improve its adaptability in use, whereby the band is improved in fittingness to the individual user's head configuration. This is also true in the following embodiments.

Figure 5:
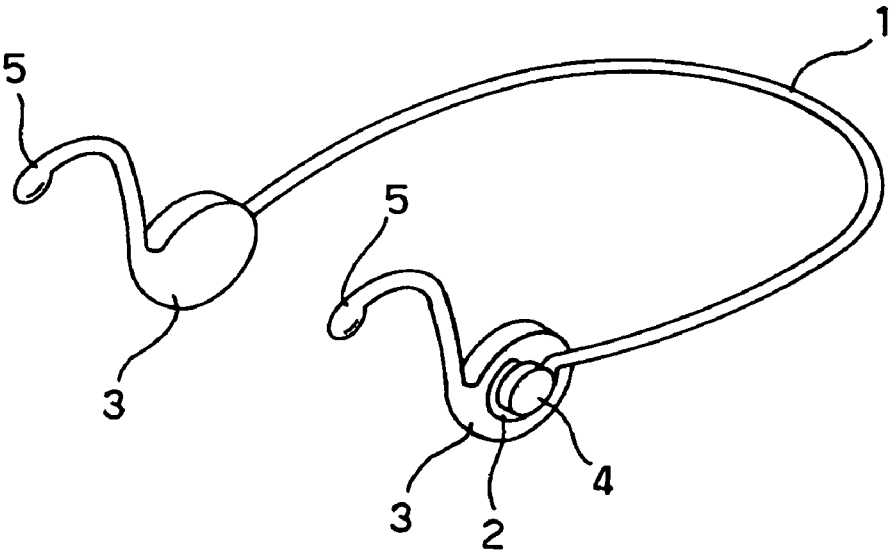
FIG. 5 is a perspective view of another embodiment of the present invention.

In another embodiment shown in FIG. 5, the ear engagement portion 5 is integrally formed with the bone conduction speaker 3. In other words, a caring of the bone conduction speaker 3 is generally made of plastics through a molding process, so that an upper portion of the casing is partially formed into the ear engagement portion 5 which has a shape capable of hanging on the user's ear. Further, as is in the above case, the knob 4 is provided in the outer surface of the bone conduction speaker 3. This knob 4 is snapped into the fastening portion 2 of the band 1 so as to support the bone conduction speaker 3.

Figure 6:
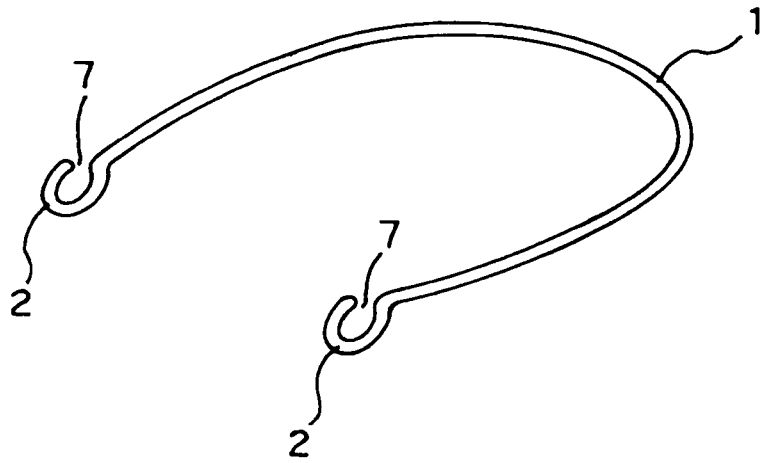
FIG. 6 is a view illustrating, in construction, the band of the embodiment shown in FIG. 5.

In this case, it suffices to form the fastening portion 2 in each of opposite end portions of the band 1, as is in the above case where the fastening portion 2 has the circularly-curved concave shape (see FIG. 6).

Figure 7:
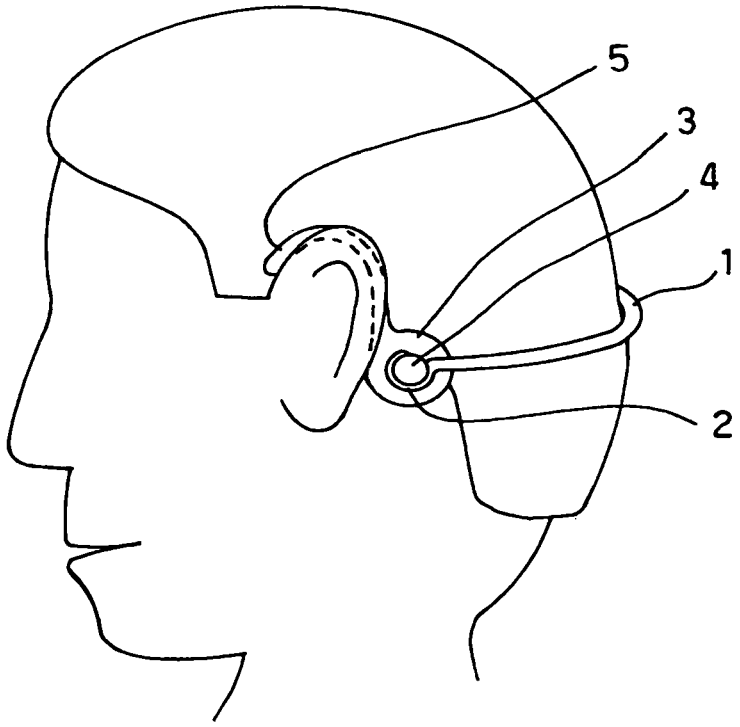
FIG. 7 is a view illustrating a state in which the headset of the embodiment shown in FIG. 5 is worn by the user.
Figure 8:
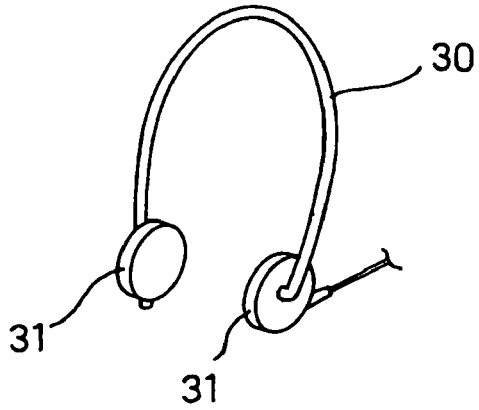
FIG. 8 (PRIOR ART)
FIG. 8 is a view illustrating, in construction, an example of the conventional headset.
Figure 9:
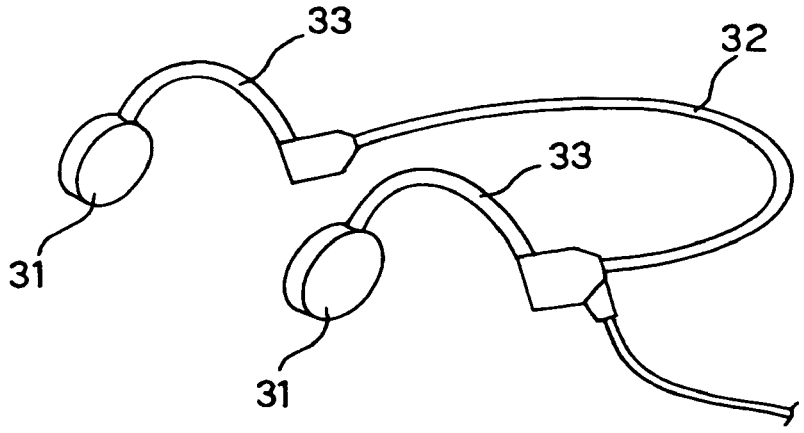
FIG. 9 (PRIOR ART)
FIG. 9 is a view illustrating, in construction, another example of the conventional headset.
Figure 10:
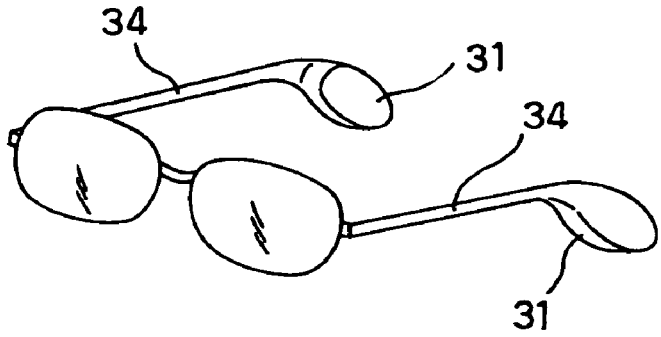
FIG. 10 (PRIOR ART)
FIG. 10 is a view illustrating, in construction, further another example of the conventional headset.
Figure 11:
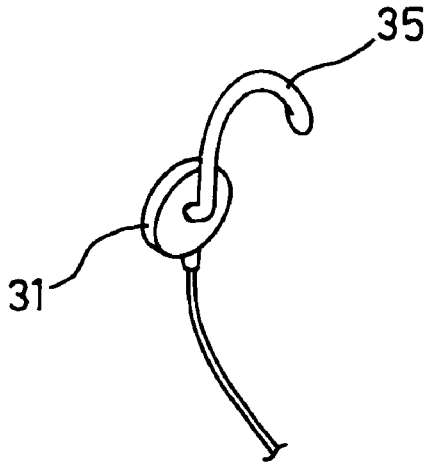
FIG. 11 (PRIOR ART)
FIG. 11 is a view illustrating, in construction, still further another example of the conventional headset.

In order to wear the headset having the above construction, it suffices to hang the ear engagement portion 5 on the user's ear after: the knob 4 is snapped in the fastening portion 2; and, the band 1 is extended around the back part of the user's head (see FIG. 7). In this state, as is in the above construction, the bone conduction speaker 3 hides behind the user's ear, and is therefore inconspicuous in appearance, so that it is hard for nearby people to find the headset thus worn by the user.

INDUSTRIAL APPLICABILITY

The present invention has a construction described in the above. Due to this, both the ear engagement portion and the bone conduction speaker may hide behind the user's ear, and the headband 1 is brought into close contact with the back part of the user's head. Consequently, when nearby people look at the user in his or her face, it is hard for the people to find the headset thus worn by the user. This is one of effects of the present invention.

The invention claimed is:

1. A bone conduction headset comprising:

a band running around a back part of a head;

a fastening portion formed in each of opposite end portions of said band;

a bone conduction speaker;

a knob which is engaged with said fastening portion positioned in an area behind an ear; and, an ear engagement portion, which runs over said bone conduction speaker during wearing to reach and engage with the ear.

2. The bone conduction headset as set forth in claim 1, wherein an extension of said fastening portion is formed into said ear engagement portion.

3. The bone conduction headset as set forth in claim 1, wherein an extension of a casing of said bone conduction speaker is formed into said ear engagement portion.

4. The bone conduction headset as set forth in claim 1, wherein said bone conduction speaker is movably engaged with said fastening portion.

5. The bone conduction headset as set forth in claim 1, wherein said band is made of a shape memory alloy.

* * * * *